US006883298B2

(12) United States Patent
Gooding et al.

(10) Patent No.: US 6,883,298 B2
(45) Date of Patent: Apr. 26, 2005

(54) APPLICATOR FOR APPLYING STRETCH FILM TO PALLETED GOODS

(76) Inventors: Brian Arthur Gooding, 19 Old Mill Road, Foxboro, Ontario (CA), K0K 2B0; Robert Kevin Walsh, 28 Pinehill Crescent, Stirling, Ontario (CA), K0K 3E0

( * ) Notice: Subject to any disclaimer, the term of this patent is extended or adjusted under 35 U.S.C. 154(b) by 37 days.

(21) Appl. No.: 10/430,672

(22) Filed: May 6, 2003

(65) Prior Publication Data

US 2003/0208994 A1 Nov. 13, 2003

(30) Foreign Application Priority Data

May 7, 2002 (CA) ..... 2385370

(51) Int. Cl.[7] ..... B65B 67/08

(52) U.S. Cl. ..... 53/592; 53/556; 53/390; 156/574; 156/577; 242/423.1; 242/588.2; 242/588.6

(58) Field of Search ..... 53/556, 592, 210, 53/219, 390; 156/574, 577, 579, 494; 242/423.1, 423.2, 588.2, 588, 588.3, 588.6; 188/156–164; 100/29, 32

(56) References Cited

U.S. PATENT DOCUMENTS 4,102,513 A * 7/1978 Guard ..... 242/423.1
4,166,348 A * 9/1979 Carlson ..... 53/556
4,166,589 A * 9/1979 Hoover et al. ..... 242/423.1
4,235,062 A 11/1980 Lancaster, III et al.
4,255,918 A 3/1981 Lancaster et al.
4,387,552 A * 6/1983 Lancaster et al. ..... 53/556
4,590,746 A * 5/1986 Humphrey ..... 53/556
4,616,474 A * 10/1986 Morley et al. ..... 53/556
4,752,045 A * 6/1988 Goldstein ..... 242/588.2
4,845,920 A 7/1989 Lancaster
5,031,771 A 7/1991 Lancaster
5,195,297 A * 3/1993 Lancaster et al. ..... 53/399
5,358,594 A * 10/1994 Darrieux ..... 156/433
5,725,726 A * 3/1998 Yu ..... 156/577
6,117,261 A * 9/2000 Ishibuchi et al. ..... 156/184
6,257,298 B1 * 7/2001 Huang ..... 156/577
6,470,657 B2 * 10/2002 Huson et al. ..... 53/588
6,598,378 B1 * 7/2003 Pottier ..... 53/556
6,712,113 B1 * 3/2004 Peggion ..... 156/577

* cited by examiner

*Primary Examiner*—Eugene Kim
*Assistant Examiner*—John Paradiso
(74) *Attorney, Agent, or Firm*—Michael Best & Friedrich LLP

(57) ABSTRACT

An apparatus for applying stretch film to goods on a pallet. It uses a basic core holder to hold a roll of stretch film which has an adjustable braking mechanism. In addition, the apparatus, which is portable, is ergonomically correct, easy to use, and has a pair of pre-stretch rollers which allow the stretch film to be pulled to increase its elasticity, thereby securing goods effectively on a pallet.

13 Claims, 7 Drawing Sheets

APPLICATOR FOR APPLYING STRETCH FILM TO PALLETED GOODS

FIELD OF THE INVENTION

This invention relates to devices which secure products, goods, and other wares on a pallet, and more particularly, to stretch film applicating devices which are portable and operable by an individual.

BACKGROUND OF THE INVENTION

For approximately the past three decades, if not more, manufacturers have realized that economies of scale are necessary to be productive. Products are therefore generally stacked on standard pallets which can be moved easily by forklift trucks. These palletized goods are often shipped by freight cars, trucks and in containers on ships. At first, the goods, whether they be cement blocks or breakfast cereal, were simply stacked on the pallets and moved about. In this unsecured fashion, goods often tumbled off the pallet or became damaged due to various transportation hazards. Manufacturers, shippers and distributors therefore decided that it would be more economical to envelop the goods on the pallet. Various things such as twine, plastic and steel strapping and other materials were used to secure the goods during shipment. Eventually, it was found that a plastic film known as "stretch film" could be applied around the goods on the pallets and do a more effective and efficient job of securing the load to the pallet. Using clear stretch film allowed the recipient to be able to recognize the contents of the palleted goods received.

Current devices used to apply stretch film have several disadvantages. For example, with limited braking and no pre-stretch mechanism, the film is not able to be stretched appropriately and often a great deal of waste occurs. Another disadvantage in some current stretch wrap applicators is that they are not portable and require a fairly complicated elevating machine which must be used in order to raise or lower the height of the stretch film application. Other devices which have been patented or on the market do not have the advantages of the present invention.

OBJECTS OF THE INVENTION

It is therefore an object of the current invention to produce a device which is ergonomically friendly, which is portable and which is lightweight. It can be used by a single operator using either one or two hands. It is furthermore an object of the present invention to permit an operator to use the device and dispense stretch film by either a pulling motion or a pushing motion around the palleted goods.

It is a further object of the present invention to have the ability to quickly and easily adjust the tension on the film by means of a preset braking mechanism. It is furthermore an object of the present invention to be able to adjust the effect of the brake to allow different loads to be wrapped with reduced or no film breaks. For example, boxes such as breakfast cereal or beer, can sustain the most tension. Cement blocks, for example, requires a different tension. Finally, oddly configured goods such as brooms or other articles which are awkward in their configuration, but still shipped on pallets, require a lesser tension.

Finally, the present invention has an object of economical film savings, optimizing the film's potential around the goods. With the extensible polymer stretch wrap, less wrap is used and the elasticity through tension gained, secures goods more than any other devices currently available.

SUMMARY OF THE INVENTION

Therefore, this invention seeks to provide a portable apparatus for applying stretch film around goods on a pallet; said apparatus comprising a handle; a pair of end frames; a core holder; and a pair of pre-stretch rollers; said core holder being adapted to engage two ends of an elongated core having stretch wrap film wound around its outer surface; said core holder, including an adjustable braking mechanism at a first top end such that in operation; said stretch wrap is applied under tension during application around said goods on said pallet.

The present invention uses film which is mounted on a central core generally made of paperboard, or for that matter, plastic, but generally paperboard, which has at its one end, a type of adjustable braking mechanism. This braking mechanism adjusts the tension on the roll for basically three types of load configurations on the pallet. These load configurations are categorized as A, B or C load types as indicated earlier. "A" type loads are generally the easiest to wrap and can endure a higher wrapping force or tension. On the contrary, a "C" type load may have multiple puncture hazards and requires a reduced film force to avoid puncturing, tearing and ultimately breaking the film. The adjusting is easily done by a simple hand grip.

The film, after leaving the core, is wound around a lower pre-stretch roller, and after that, about an upper pre-stretch roller. The rollers engage each other by means of gears at one end of the apparatus, i.e., what is known as the first or top frame. The lower roller has substantially more teeth than the upper roller and thus the upper roller rotates faster than the lower roller, thereby creating a fixed pre-stretch of the film. In an alternative embodiment, the rotation of the pre-stretch rollers may be assisted by attaching a sub fractional motor adapted to turn said gears.

The apparatus is also equipped with triangular substantially planar end frames. The end frame, which is intended to be placed downwardly during application of the wrap, is almost exclusively planar, such that the wrap can be applied around the bottom of the pallet itself and not only the goods, thus fully unitizing the load. The opposite end frame has the brake adjustment knob protruding therefrom. The brake adjustment nob is equipped with an earth magnet and it is attracted towards a large washer by means of various screws and sleeves, which will be described later in detail. A coupler is attached to the intermediate bracket, the coupler being adapted to being inserted into the core of the film roll. The intermediate bracket has an elongated slot on its circumferential surface which has a number of recesses. These are adapted to be engaged by a spring-loaded bearing screw located in the adjustment nob. By turning the adjustment nob, the earth magnet moves closer to the metal washer which increases the force of the coupler closer to a rubber O-ring which acts as a brake. This obviously increases the tension on the core.

In an alternative embodiment, the core coupler contains a first disk brake pad in an annular groove and a second disk brake pad is inserted in an annular groove in the intermediate bracket. Similarly, as the earth magnet moves closer to the metal washer, it increases the force of the notched core coupler containing one of the disk brake pads against the second disk brake pad inserted in the annular recess in the intermediate bracket.

This obviously increases the braking action on the core which increase the unwind tension on the stretch film producing higher stretch levels. The core coupler has projections which are adapted to fit into pre-cut notches in the paperboard or plastic core supporting the stretch film. These notches effectively control the film's unwind speed into the pre-stretch mechanism, thereby adapting film tension to load type and play an integral role in transferring the various brake forces which effect the degree of stretch and applied containment force on the load. These notches are made during the manufacture of the core for stretch film adapted to be used with this particular apparatus.

To facilitate loading and unloading of the core holding the plastic film, the opposite end of the coupler uses a pivotal bolt which pivots within the end frame, this being attached to a second coupler. The coupler can be turned outwardly and the core with stretch film, at one end can be placed thereon. The coupler, at the spring-loaded end, is tapered and fits easily into the core. Thereafter, with some pressure, the-core is moved towards the spring-loaded pivotal bolt and the opposite end placed on the coupler of the adjustable braking mechanism. The compression strength of the spring is sufficient to position the core on which the film is wound, up to, but not against, the coupler of the adjustable braking mechanism.

BRIEF DESCRIPTION OF THE DRAWINGS

This invention will be described in greater detail in conjunction with the following drawings wherein.

DETAILED DESCRIPTION OF THE DRAWINGS

Figure 1:
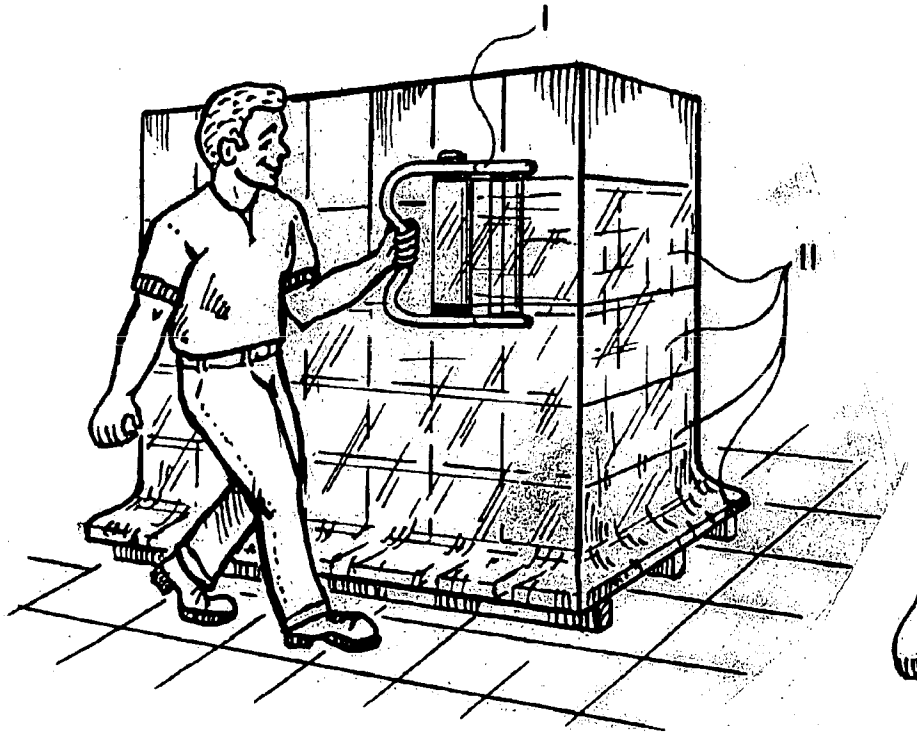
FIG. 1 is a perspective drawing of an operator applying stretch wrap to a pallet of goods with the present invention.
Figure 1A:
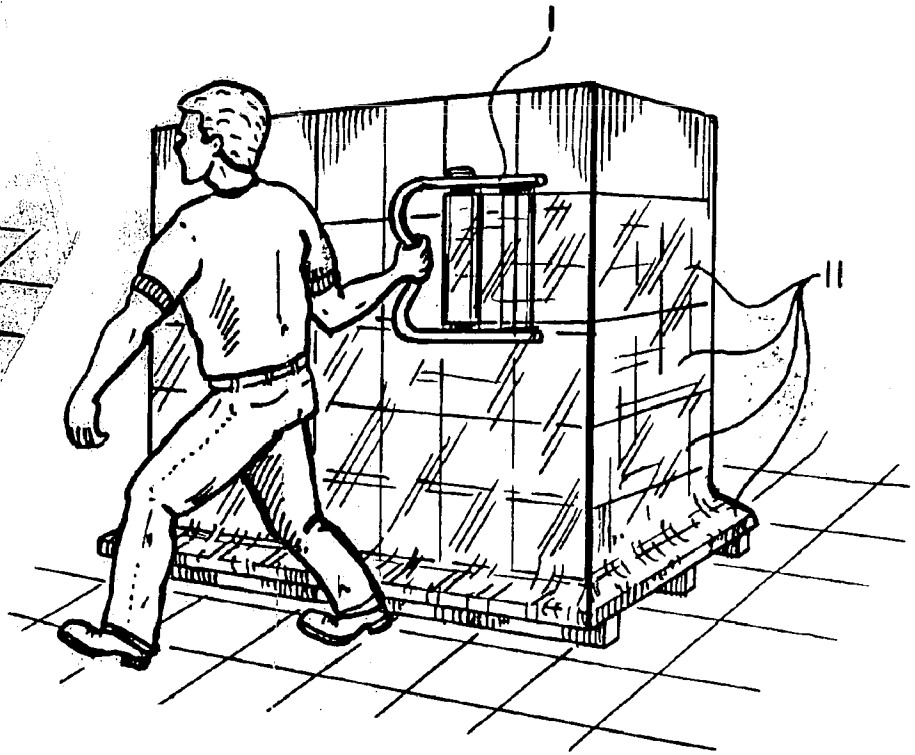
FIG. 1A is similar to FIG. 1 except the operator is walking forwards.

In FIGS. 1 and 1A, an operator is applying film 11 to a pallet of goods to be shipped using the apparatus 1 of the present invention. The operator may apply film walking either frontwards or backwards.

Figure 2:
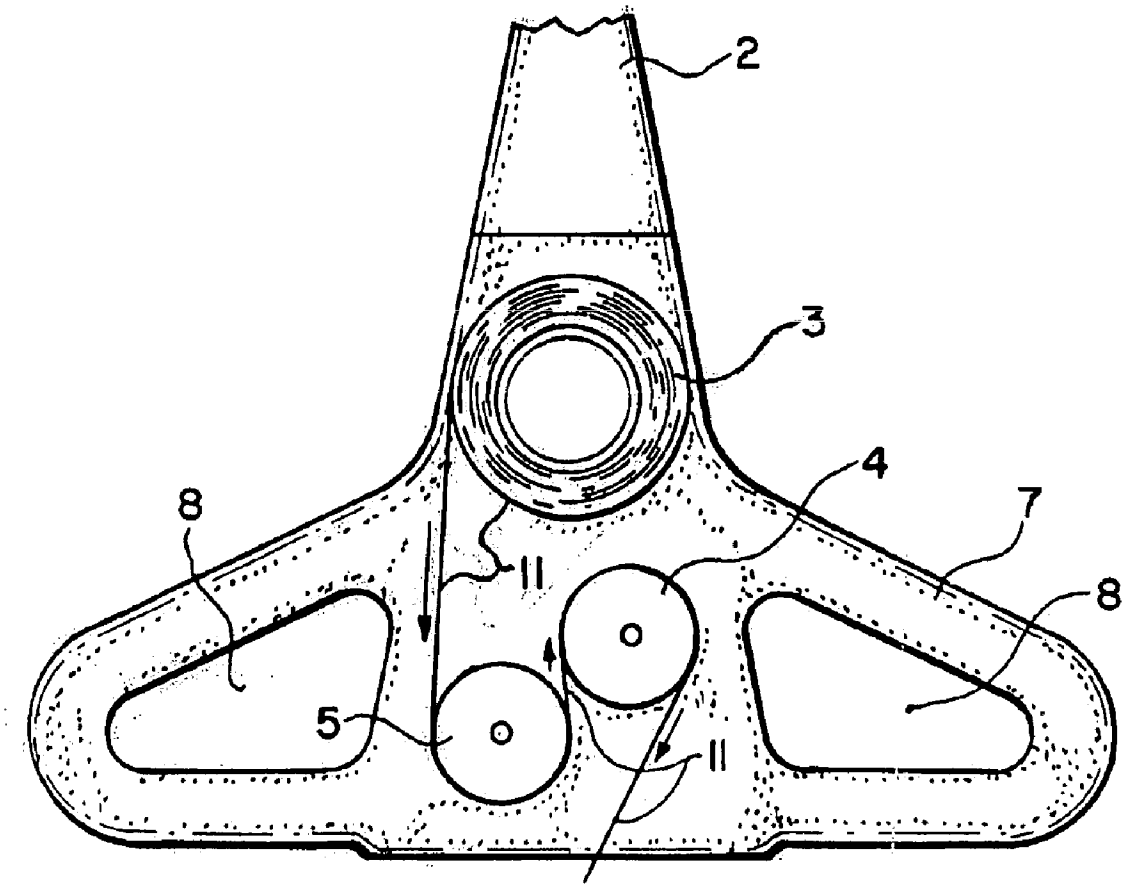
FIG. 2 is an end view of the manual stretch wrapper of the present invention showing the direction of the film.

In FIG. 2, one views apparatus 1 by the end view and notes the direction of the dispensing film 11. Handle 2 is upward most in the drawing. Numeral 3 indicates and end of the film cartridge or paperboard core with film wrapped thereupon. The film first moves below lower first pre-stretch roller 5 which is equipped with a large number of teeth on its gear. The film thereafter moves around roller 4, which is the upper second pre-stretch roller, which has a different gear ratio of fewer teeth. Thus, the film is tensioned between roller 5 and roller 4 as roller 4 rotates faster. Numeral 7 denotes the lower first triangular end frame which has apertures 8 therein to reduce weight.

As is visible in FIG. 2, upper end frame 6 and lower end frame 7 (visible in FIG. 3), are substantially planar in nature and thus the operator can place apparatus 1 on the floor without damaging the film when it is not in use.

Figure 3:
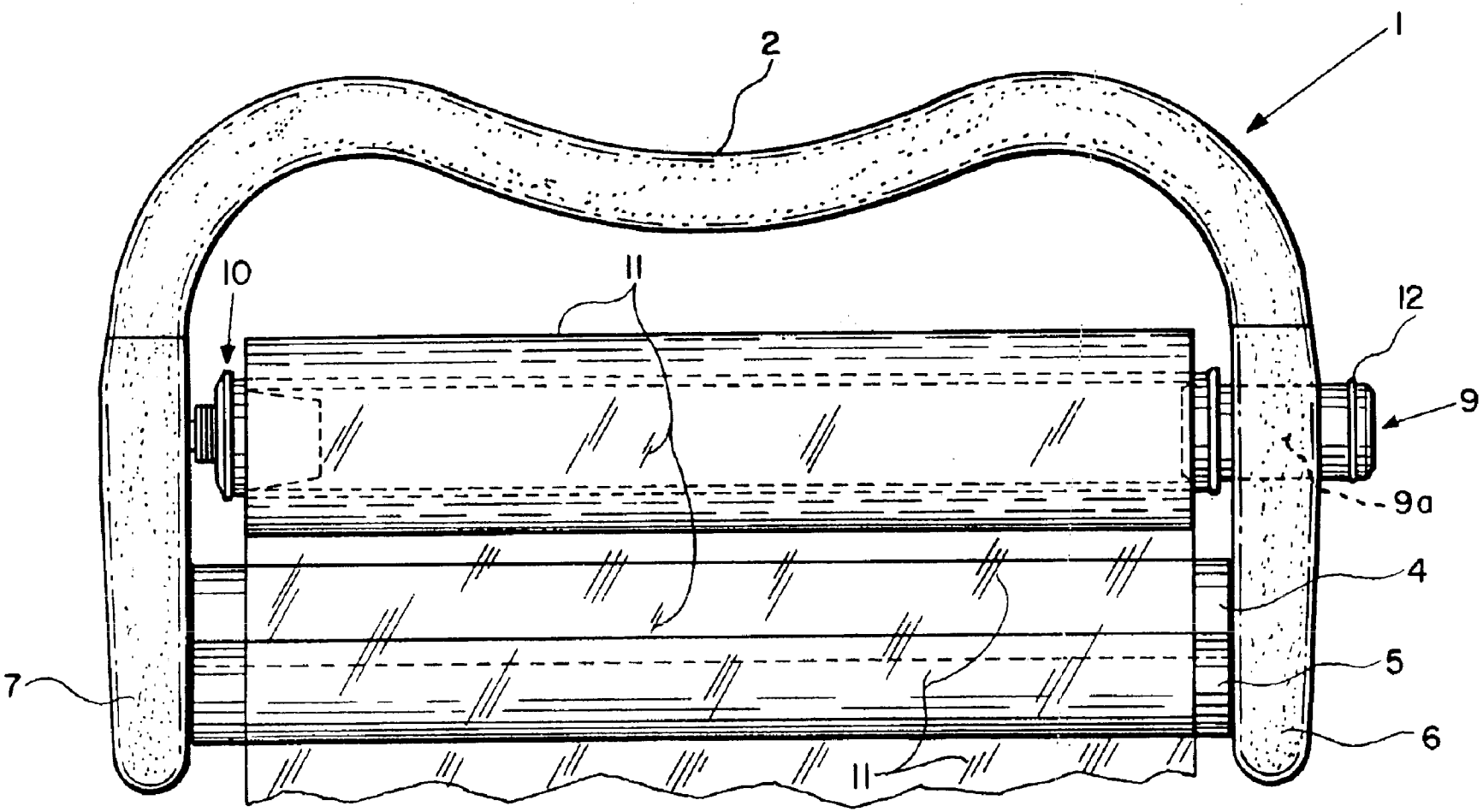
FIG. 3 is a front view of the present invention.

FIG. 3 shows the serpentine handle marked as 2. This handle for the apparatus is very effective as it can be used with one hand only on the top portion or both hands when the operator is applying the film.

In a preferred embodiment, the first or upper end 6 of the apparatus 1 has a magnetic tension brake adjuster assembly 9 which fits through aperture 9*a* of end frame 6. It is equipped with a rubber hand grip 12. As can be seen in FIG. 3, the opposite end of the core of stretch film 11 is held by an end core coupler 10. This is shown in broken lines and is tapered for easy insertion. This coupler is also spring loaded and pivotal and will be discussed in later drawings.

Figure 4:
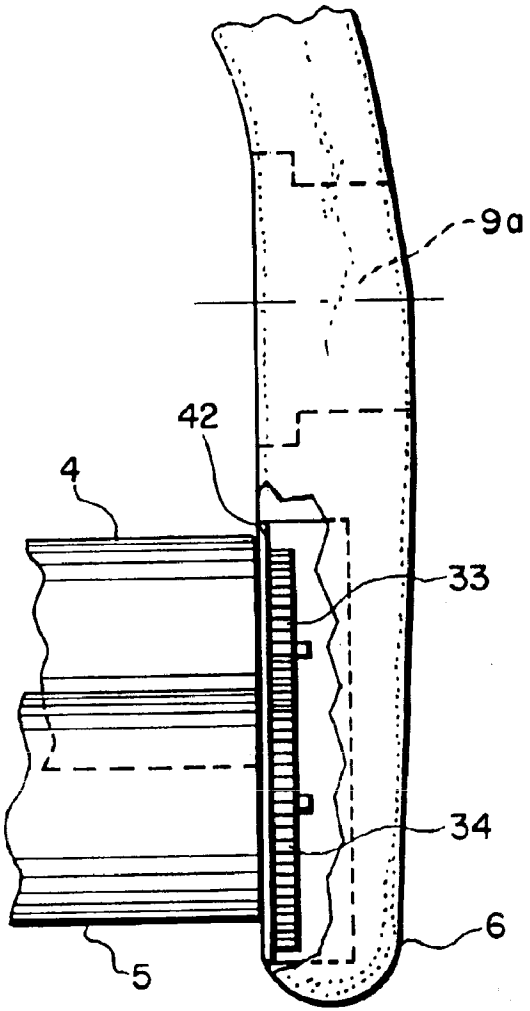
FIG. 4 is an expanded side view of the gear mechanism of the pre-stretch rollers of the present invention.

In FIG. 4 one views a cut away cross section of a front view of the first or upper triangular end frame 6 showing the pre-stretch rollers 4 and 5. As can be noted, the upper pre-stretch roller 4 has fewer teeth marked as 33 on the mesh gear. The lower pre-stretch roller 5 has more teeth marked as 34. These teeth intermesh during operation. Also shown in FIG. 4 is that the gears are mounted within a frame plate 42 on the inside of the first or top end frame 6.

Figure 5:
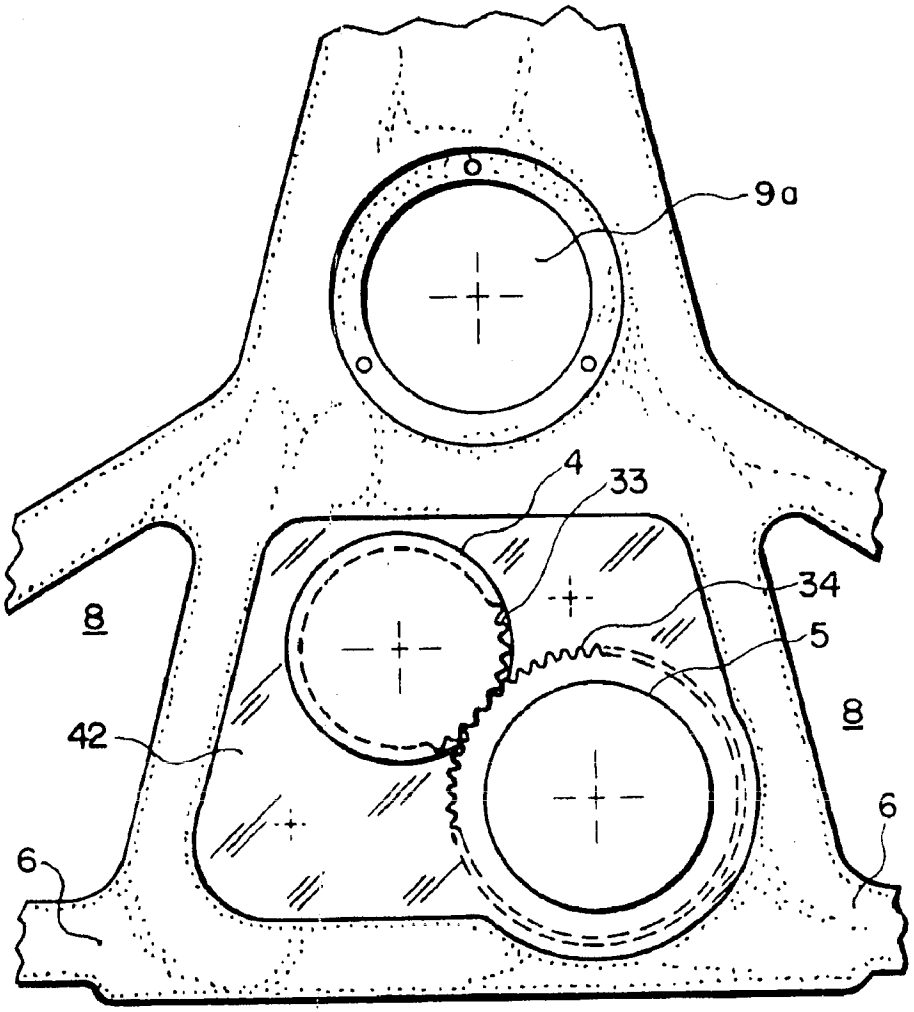
FIG. 5 is a cut away end view of the gears of the pre-stretch rollers of the present invention.

FIG. 5 is an end view of similar components showing upper pre-stretch roller 4, lower pre-stretch roller 5, gear mesh teeth 33, and gear mesh teeth 34. End frame 6 has been cut away such that apertures 8 are shown in cut away view.

Figure 6:
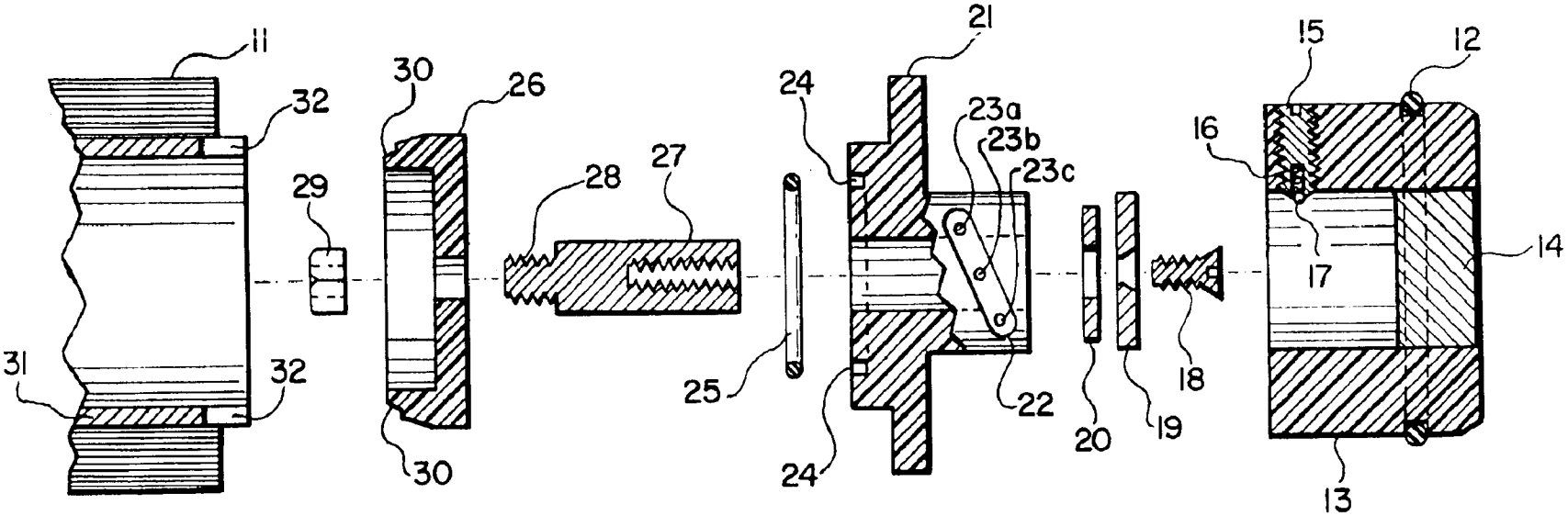
FIG. 6 is an exploded view of the brake adjustment mechanism.

FIG. 6 is a detailed exploded view of the essential components of the most important part of the invention. Numeral 13 denotes the tension nob of the brake adjustment assembly. It has, at its extreme end, imbedded therein, an earth magnet 14. It also contains a spring-loaded tension screw 15 having a spring 16 thereon and a ball bearing 17. Nob 13 is in no way attached to the remainder of the mechanism but simply is drawn to it by the attraction of magnet 14 to large inset washer 19. An Allen screw 18 secures large inset washer 19 and smaller washer 20 into frame support intermediate bracket 21 and thereafter through to sleeve 27, which is actually a sleeve drilled for Allen screw 18, having a threaded end bolt 28 which is adapted to pass through a core coupler 26 and be secured by nut 29.

Located on the cylindrical portion of frame support intermediate bracket 21 is an oblique slot 22 which has recesses 23A, 23B and 23C. These recesses are adapted to receive ball bearing 17 protruding into the interior of nob 13. Thus, as can be visualized by the drawing, as nob 13 is turned, the ball bearing brings tension nob 13 and thus magnet 14 closer to washer 19 thereby further drawing coupler 26 against O-ring 25 which acts as a braking mechanism. O-ring 25 is inserted into annular recess 24 of intermediate bracket 21. Thus as can be seen when all components are attached to coupler 26 through bracket 21, the adjustment by circular motion of nob 13 will cause greater friction between O-ring 25 and coupler 26 which therefore tends to increase the force required to rotate the coupler 26 and film core 31.

Figure 7:
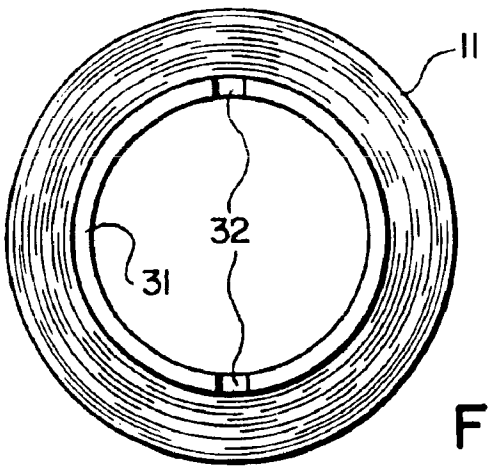
FIG. 7 is an end view of the core with stretch film wrap thereon.

In a preferred embodiment, coupler 26 is equipped with two projections 30. These are adapted to fit within notches 32 as shown in FIG. 7. Thus the plastic film 11 is not permitted to rotate and dispense without rotation of coupler 26. It should be noted that any number of projections can be used, however, the cores of plastic film must be notched accordingly.

Figure 8:
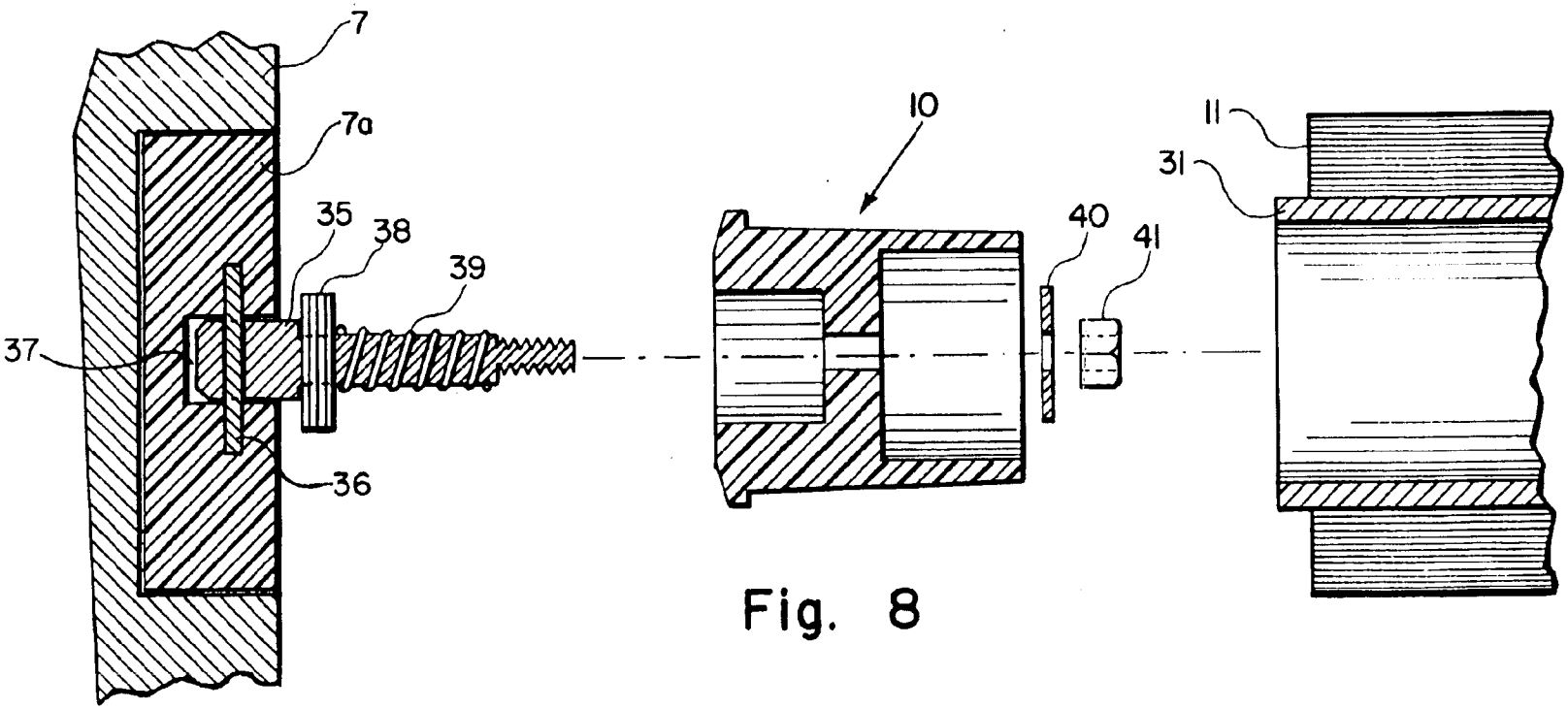
FIG. 8 is an exploded cross section of the pivot end of the core coupler.
Figure 9:
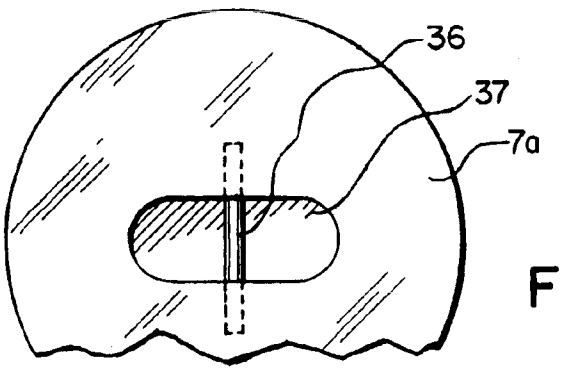
FIG. 9 is an end view of the internal portion of the second or lower triangular end frame with the pivot shown therein.

FIGS. 8 and 9 show the opposite end of the coupler for the film 11 and paperboard or plastic core 31. The pivoted end core coupler 10, which is somewhat tapered, has no braking ability but is spring loaded and adapted to engage a refill cartridge 31 once film 11 has been dispensed from a first cartridge or core 31. Bolt 35 is pivotable about a hinge 36. This is located in a pivot slot 37 located in end frame 7 in a recess 7A. Bolt 35 is equipped with shim washers 38 and a spring 39. Pivot bolt 35 protrudes through core coupler 10 through washer 40 and nut 41. Thus core coupler 10 is normally resiliently biased outwardly towards core 31 except during removal of an old core 31 and during mounting of a new core 31 with fresh film 11 thereon. As previously mentioned, core 10 has no braking mechanism ability and therefore need not be fixedly secured to core 31.

Figure 10:
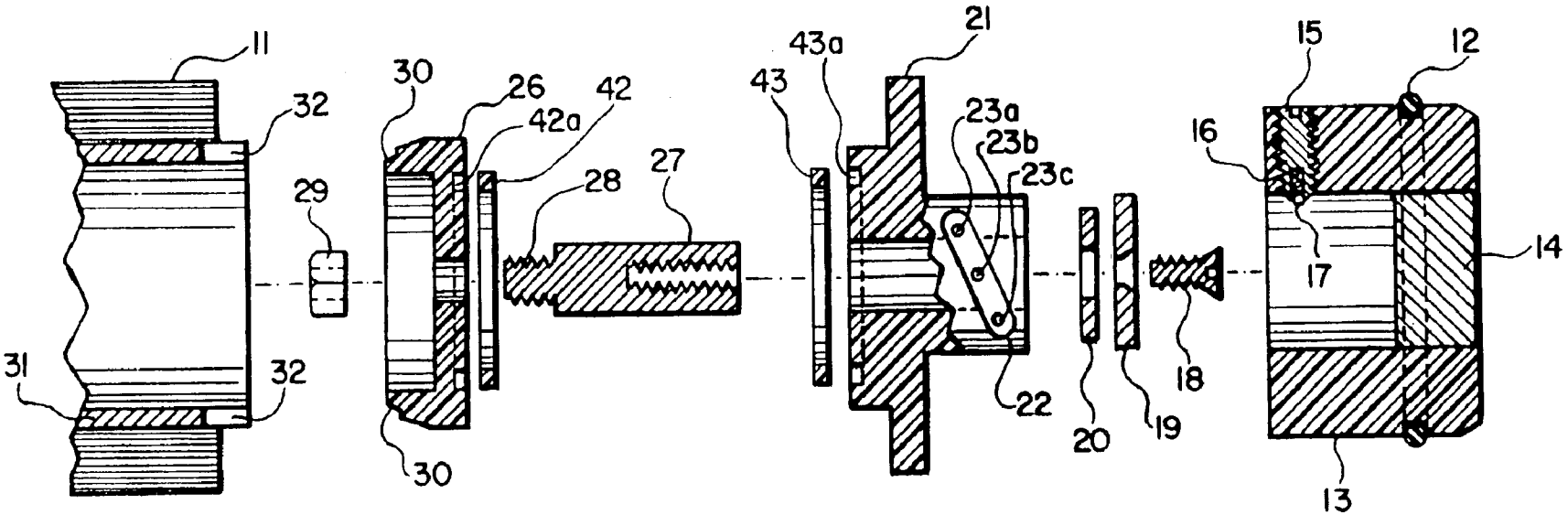
FIG. 10 is an exploded view of an alternative brake adjustment mechanism using two discs replacing the O-ring.

In FIG. 10, an alternative braking mechanism is shown. One disk brake pad 42 is located in annular recess 42*a* of coupler 26 and another disc brake pad 43 is located in an annular recess 43*a* in intermediate bracket 21. In operation as magnet 14 is moved closer to washer 19, it increases the force on coupler 26 containing disk 42 against disc 43 located in recess 43*a* in intermediate bracket 21.

This invention has been described using a preferred embodiment, however, it is to be understood that any device incorporating a pair of geared pre-stretched rollers and an adjustable brake mechanism to apply stretch wrap is encompassed by this invention.

What is claimed is:

1. A manual handheld apparatus for applying stretch film around goods on a pallet, said apparatus comprising: a handle; a pair of end frames; an unheated stretch film core holder; and a first downstream pre-stretch roller and a second upstream pre-stretch roller; said pre-stretch rollers being in geared relationship with one another and rotating independently of said stretch film core holder; said first downstream pre-stretch roller rotating faster than said second upstream roller; said rollers being rotated in operation by tension exerted on said stretch film around goods on a pallet by an operator; said core holder being adapted to engage two ends of an elongated core having stretch wrap film wrapped there around; said core holder including an adjustable braking mechanism at a first top end; said adjustable braking mechanism including a tension knob with an earth magnet inserted therein at one end, remote from said stretch film; a large inset washer adapted to attract said earth magnet; an oblique slot containing at least three recesses; said recesses being adapted to receive a spring loaded ball bearing projecting inwardly in said knob; wherein in operation, manual rotation of said knob decreases or increases friction on said core holder; such that in operation, said stretch wrap is under tension during application around said goods on said pallet.

2. An apparatus as claimed in claim 1 wherein said core holder includes a second bottom end opposite said first top end; said second bottom end being cone-shaped, pivotally mounted, and spring loaded such that in operation, said core holder wound with stretch film is resiliently biased towards said adjustable braking mechanism located at said first top end.

3. An apparatus as claimed in claim 2 wherein said second bottom end of said core holder includes a pivot pin and a taper bolt mounted on said pin adapted to be mounted in a recess of said second bottom end frame; said bolt, including a plurality of washers and a compression spring mounted thereon and adapted to secure said bottom end of said core coupler by means of a washer and nut.

4. An apparatus as claimed in claim 1 wherein first and second ends of said handle are fixedly attached to said end frames which are further defined as a first top end frame and a second bottom end frame, said end frames being substantially triangular and planar; said two pre-stretch rollers being mounted there between; said braking mechanism also being mounted in said first top frame end and a second bottom end of said core holder being mounted in said second bottom frame end; said core holder, and said pre-stretch rollers being mounted such that they are in line at opposite ends and parallel to one another.

5. An apparatus as claimed in claim 4 wherein said bottom frame is substantially planar on an outside surface, whereby in operation, permitting an operator to apply film around both a portion of said pallet as well as said goods.

6. An apparatus as claimed in claim 1 wherein said end frame are further defined as a first top end frame and a second bottom end frame, and wherein said pre-stretch rollers in geared relationship include gears mounted on said rollers adjacent to said first top end frame; said gears on said downstream pre-stretch roller including fewer gear teeth than those on said upstream pre-stretch roller; such that said downstream roller rotates at a greater speed than said upstream roller, thereby increasing tension on said stretch wrap and promoting uniform wrapping with greater elasticity.

7. An apparatus with a braking mechanism as claimed in claim 1 wherein in operation, tension on said core is varied by said braking mechanism such that at least two different frictional tensions can be applied to said stretch wrap and said good on a pallet.

8. An apparatus with a braking mechanism as claimed in claim 1, wherein said end frames are further defined as a first top end frame and a second bottom end frame, the apparatus also including a frame support intermediate bracket, and a core coupler, said bracket being fixedly attached to said first top end frame and rotatably secured to said core coupler by means of a screw adapted to engage a screw sleeve which includes a threaded end adapted to pass through said coupler and be secured by a nut.

9. An apparatus with a braking mechanism as claimed in claim 8, including washers secured on said screw within said intermediate bracket; said intermediate bracket including an annular recess on an inner portion; said annular recess being adapted to receive an O-ring, said O-ring in operation creating friction on said coupler.

10. An apparatus with a braking mechanism as claimed in claim 9 wherein in operation, as said knob is rotated, said magnet draws said knob towards or away from said bracket thereby increasing or decreasing friction between said O-ring and said coupler.

11. An apparatus as claimed in claim 8 wherein a bottom end of said coupler has a plurality of linear projections being adapted to engage factory-made predetermined notches in said core with said stretch film wrapped there around.

12. An apparatus with a braking mechanism as claimed in claim 8, including washers secured on said screw within said intermediate bracket; said adjustment knob further including an earth magnet; said intermediate bracket further including an oblique slot on an outer portion having a plurality of recesses therein, and an annular recess on an inner portion; said inner annular recess being adapted to receive a first disk brake pad and said coupler includes, in an annular recess a second disk brake pad; wherein in operation, increased friction between said disk brake pads reduces ease of rotation of said core coupler.

13. An apparatus with a braking mechanism as claimed in claim 12, wherein said adjustment knob further includes a tension screw with a spring-loaded bearing on the tip of said tension screw which is adapted to be received by recesses in said oblique slot, wherein in operation, as said knob is rotated, said tension screw projects into recesses increasingly closer to said coupler and said magnet draws said knob towards said bracket thereby creating friction between said first and second disk brake pads, thus creating resistance to rotation of said core having stretch wrap film thereon.

* * * * *